United States Patent [19]

Chiu

[11] Patent Number: 4,492,826

[45] Date of Patent: Jan. 8, 1985

[54] LOUDSPEAKER

[75] Inventor: Robert C. Chiu, Downey, Calif.

[73] Assignee: R&C Chiu International, Inc., City of Industry, Calif.

[21] Appl. No.: 406,780

[22] Filed: Aug. 10, 1982

[51] Int. Cl.[3] ..... H04R 1/24

[52] U.S. Cl. ..... 179/115.5 PS; 181/156; 381/86; 381/87; 179/116

[58] Field of Search .... 179/116, 115.5 PS, 115.5 DV; 181/156; 381/86, 87

[56] References Cited

U.S. PATENT DOCUMENTS

| | | | |
|---|---|---|---|
| 1,915,692 | 3/1934 | Evens | 179/115.5 PS |
| 2,122,587 | 7/1938 | Ringel | 179/116 |
| 2,496,589 | 2/1950 | Marquis | 179/116 |
| 2,539,672 | 1/1951 | Olson | 179/116 |
| 2,699,472 | 1/1955 | Olson | 179/116 |

FOREIGN PATENT DOCUMENTS

| | | | |
|---|---|---|---|
| 14521 | 9/1933 | Australia | 179/116 |
| 14604 | 10/1933 | Australia | 179/116 |
| 55-46650 | 4/1980 | Japan | 179/116 |
| 55-64497 | 5/1980 | Japan | 179/116 |
| 57-65994 | 4/1982 | Japan | 179/116 |
| 641651 | 8/1950 | United Kingdom | 179/115.5 PS |

*Primary Examiner*—Gene Z. Rubinson
*Assistant Examiner*—L. C. Schroeder
*Attorney, Agent, or Firm*—Christie, Parker & Hale

[57] ABSTRACT

A high fidelity loudspeaker system having at least one additional smaller speaker mounted above the largest speaker. The loudspeaker is of the type having a permanent magnet and a moving coil, and the smaller speaker or speakers are mounted on a support member which passes through the moving coil of the largest speaker. The mounted base for the smaller speaker or speakers is held to a support pedestal by a set of male and female interlocking members.

3 Claims, 2 Drawing Figures

LOUDSPEAKER

BACKGROUND OF THE DISCLOSURE

The field of the invention is high fidelity loudspeakers and the invention relates more particularly to loudspeakers of the type used in automobiles and other motor vehicles. Such speakers are subjected to a considerable amount of vibration over and above the vibration created by the speaker system itself. The large jarring movements caused by, for instance, an automobile going over a large bump has created the need for a very secure support system.

With increased interest in high fidelity in automobile loudspeakers and with the limit in size inherent in automobiles, it has become common to provide a speaker system which has one or more smaller speakers mounted within the speaker cone of the largest speaker. Typically, such smaller speakers have been mounted on a bridge which has four arms which pass to the outer edge of the large speaker and which are affixed to the frame of the larger speaker. This has at least two disadvantages. First, it is esthetically unpleasing and, second, it blocks a relatively large amount of the surface area above the largest cone which inhibits the passage of sound from the largest cone.

A preferable approach has been used which calls for the mounting of the smaller speaker or speakers on a pedestal which passes through the moving coil of the largest speaker. Typically, the smaller speaker or speakers are glued or otherwise affixed to a frame which is held to the pedestal by a nut and bolt arrangement. While this provides excellent sound, it has a substantial drawback in that the smaller speaker often turns and becomes loose with respect to the support pedestal and sound distortion results.

SUMMARY OF THE INVENTION

It is thus an object of the present invention to provide a more secure support system for one or more small speakers above the tone of a large speaker.

The present invention is for a high fidelity loudspeaker system of the type having a permanent magnet and a moving coil which drives the speaker of the largest speaker of the system. Such speakers are also of the type which have at least one additional smaller speaker mounted above the speaker cone of the largest speaker and supported from a support member which passes through the moving coil of the largest speaker. A first support pedestal is affixed to the permanent magnet of the largest speaker and has a first set of keyed male and female interlocking members. A second support pedestal is affixed to the permanent magnet of at least one of the smaller speakers, said second support pedestal having the second of a set of keyed male and female interlocking members and fastening means are provided which pass through the first support pedestal and terminate within the second support pedestal to hold the two pedestals together whereby the second smaller speaker or speakers may be securely held above the cone of the large speaker even when the assembly is subjected to the vibration of a motor vehicle. Preferably, the keyed male and female interlocking members comprise a square (or other polygon) protrusion which fits into a similarly shaped indentation in the other member. While a square or other polygon is particularly easy to fabricate, other keyed shapes including the classic T-hole shape may be used in place of a square or other polygon.

DESCRIPTION OF THE PREFERRED EMBODIMENTS

Figure 1:
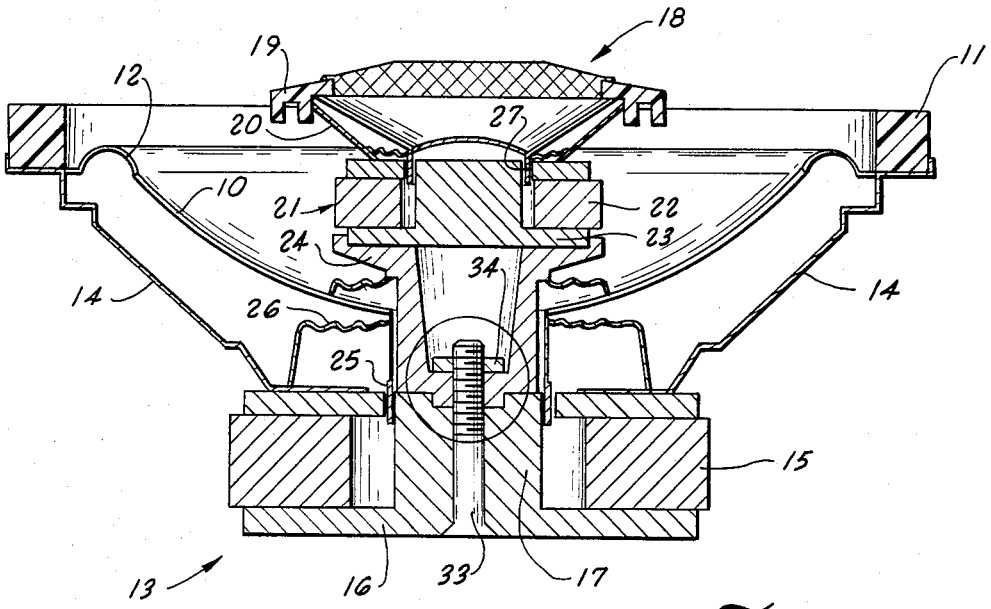
FIG. 1 is a cross-sectional view of the speaker system of the present invention.

The speaker system of the present invention is shown in cross-sectional view in FIG. 1 of the drawings. The cone of the large speaker is indicated by reference character 10 and this is held to outer ring 11 by a thin sheet of foam 12. The cone is of the type which is generally referred to as a foam air suspension cone. Ring 11 is held to the permanent magnet assembly 13 by rigid frame 14.

Permanent magnet 15 is typically a ferrite magnet. A support disk 16 which has an integral cylindrical support pedestal 17 is held to the permanent magnet 15 by an adhesive or other attachment means. (Support pedestal 17 also functions as a pole of the larger speaker.)

A second high frequency speaker is indicated generally by reference character 18. Like the larger speaker, it has an outer ring 19, a rigid frame 20 which is held to a second permanent magnet assembly 21 which has permanent magnet 22 in the center thereof. A second metalic support disk and pole assembly 23 is held on a second support pedestal 24 in a manner described more fully below.

Returning now to the operation of the larger speaker, a moving coil 25 drives the foam air suspension cone 10 in a conventional manner. A corrugated diaphragm 26 is also affixed to moving coil 25 and it is also conventional. The high frequency speaker 18 also has a moving coil 27 which is likewise conventional.

Figure 2:
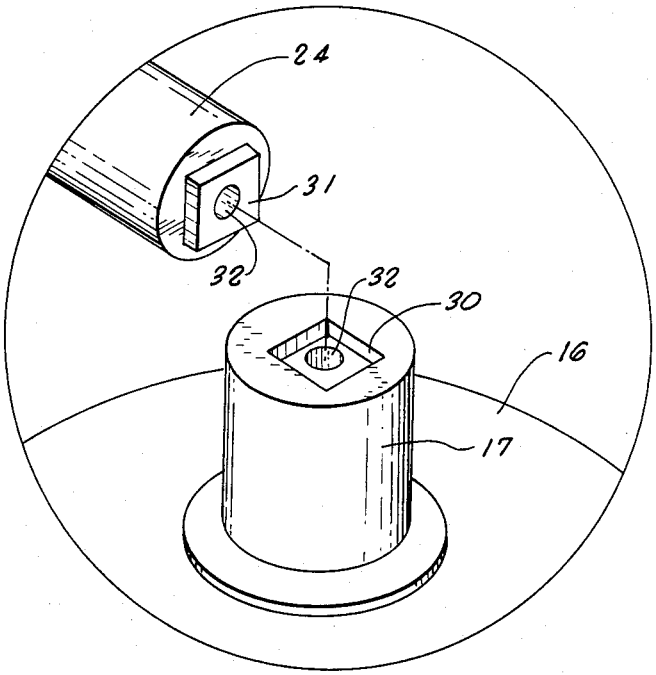
FIG. 2 is an enlarged, exploded, perspective view of the first and second support pedestals of the speaker system of FIG. 1.

Turning now to the support of speaker 18 through moving coil 27, the details of the attachment of support pedestal 24 to support pedestal 17 is shown best in FIG. 2. The support disk and support pedestal 17 (which also functions as a pole of the larger speaker) and a square flute 30 is molded or otherwise formed in the upper surface of support pedestal 17, and identically shaped square protrusion 31 is formed in the bottom surface of support pedestal 24. Both support pedestal 24 and 17 have a central opening 32 for passage of a bolt or other holding means. While a square protrusion 31 is shown in the drawings, other shapes may be used as long as they prevent a rotation of support pedestal 24 with respect to support pedestal 17. It has been found that if rotation is prevented that a secure attachment of the small speaker above the large speaker will result even though the speaker is subjected to severe vibration. Adhesive is preferably used to further reduce any vibration between the two pedestals. A bolt 33 is screwed into a nut 34 which is affixed to the inner opening of the upper support pedestal 24. An adhesive is also preferably used on bolt 33 to further secure the assembly.

The upper support frame, although shown in the drawings as supporting a single high frequency speaker, may support two or more speakers and most typically supports a high frequency driver and mid-range speaker. The resulting assembly is not only highly permanent even in high vibration environments, but also provides exceptionally good tonal qualities.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A high fidelity loudspeaker system of the type having a permanent magnet and a moving coil which drives the speaker cone of the largest speaker of the system and further being of the type which has at least one additional smaller speaker mounted above the speaker cone and supported from a support member which passes through the moving coil, wherein the improvement comprises:

a first support pedestal affixed to the permanent magnet of the largest speaker having the first of a set of non-circular keyed male and female interlocking members:

a second support pedestal affixed to the permanent magnet of at least one of the smaller speakers, said second support pedestal having the second of a set of keyed male and female interlocking members; and fastening means passing through said first support pedestal and terminating within said second support pedestal to hold the two pedestals together, whereby a second smaller speaker may be securely held above the cone of a larger speaker even when the assembly is subjected to the vibration of a motor vehicle.

2. The speaker assembly of claim 1 wherein said male interlocking member is square.

3. The speaker assembly of claim 1 wherein said fastening means is a bolt which is screwed into a nut imbedded in the second support pedestal.

* * * * *